US005347944A

United States Patent [19]

Dupré et al.

[11] Patent Number: 5,347,944

[45] Date of Patent: Sep. 20, 1994

[54] DEEP SEA SUPER PORT

[76] Inventors: Joseph K. Dupré, La Porte; William Lamb, Houston, both of Tex.

[21] Appl. No.: 745,463

[22] Filed: Aug. 14, 1991

[51] Int. Cl.[5] ..... B63B 3/02

[52] U.S. Cl. ..... 114/77 R; 114/46; 114/258

[58] Field of Search ..... 114/77 R, 77 A, 46, 114/258

[56] References Cited

U.S. PATENT DOCUMENTS

| | | | |
|---|---|---|---|
| 2,465,851 | 3/1949 | Crandall | 114/46 |
| 2,728,319 | 12/1955 | Engstrand | 114/77 R |
| 2,732,818 | 1/1956 | Quirin | 114/77 R |

*Primary Examiner*—Jesus D. Sotelo
*Attorney, Agent, or Firm*—Arnold, White & Durkee

[57] ABSTRACT

A superport/vessel is disclosed that is capable of quickly and efficiently handling off shore cargo transportation and oil production problems. The super port/vessel is modularly constructed.

3 Claims, 7 Drawing Sheets

Fig. 4
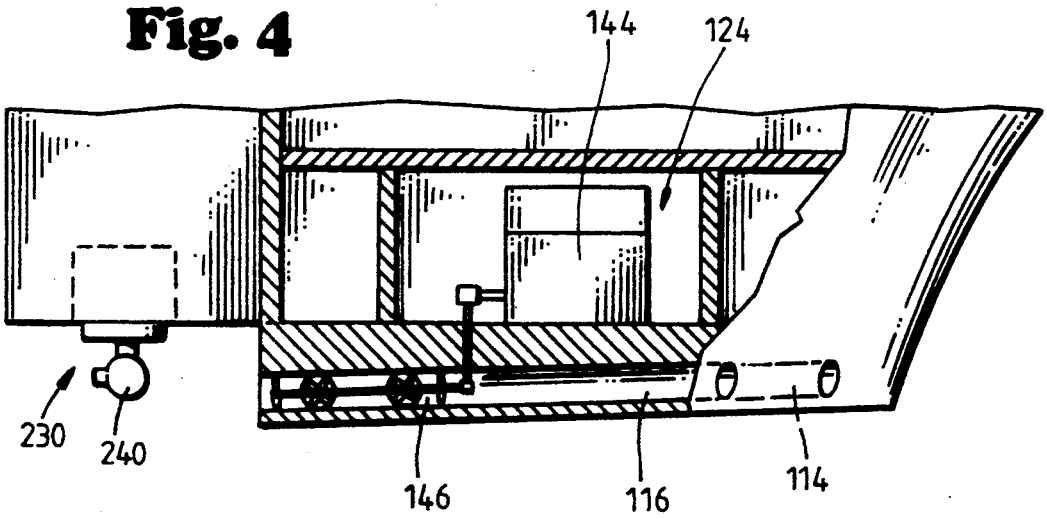
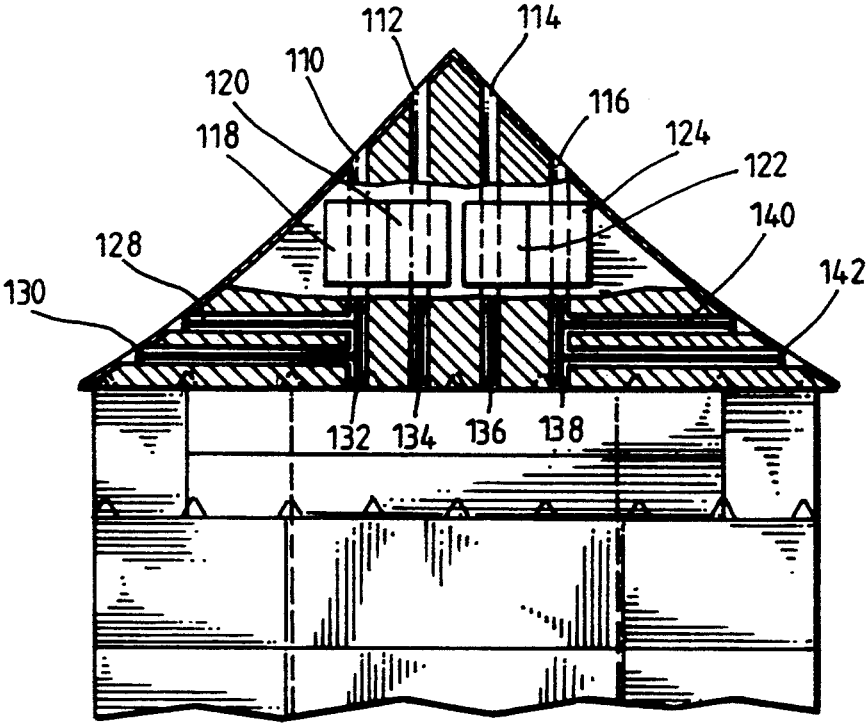
Fig. 3

Fig. 5
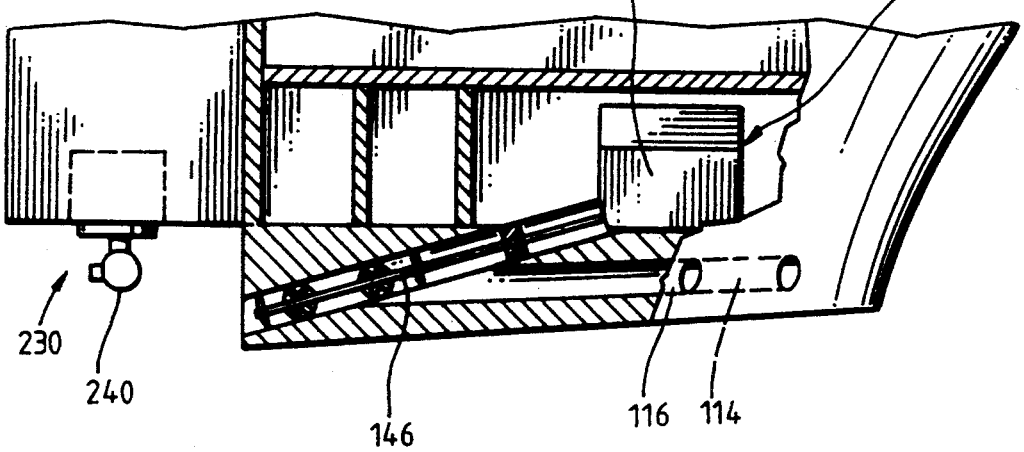
Fig. 6
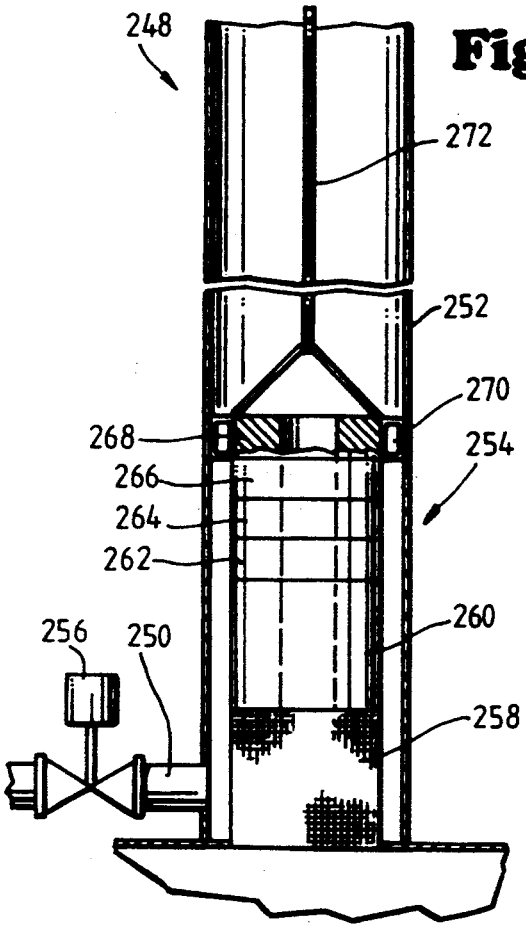
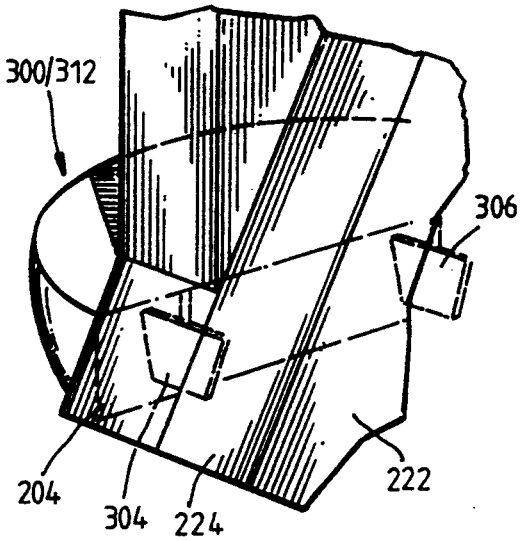
Fig. 7

DEEP SEA SUPER PORT

FIELD OF THE INVENTION

The invention relates to a multi-purpose vessel/port. More specifically it relates to a modularly constructed super vessel/port capable of fully containing the largest known oceangoing vessels.

BACKGROUND OF THE INVENTION

Oil and its products are essential to our present day existence. Its supply is not limitless. Thus it is important that we handle, protect, conserve, and use oil wisely.

Oil is transported around the earth in vessels and pipelines. Vessels carry large amounts of oil across oceans, seas, and through inland rivers and waterways. Pipelines carry oil under water from shore to shore and from superports to shore. Presently both provide our best and most efficient means of transporting oil across and through water.

Unfortunately, these vessels and pipelines are not perfect, nor are the people who control them. Occasionally a mishap occurs where a vessel or pipeline fails, causing oil spills and fires.

For instance, on Mar. 24, 1989, the supertanker Exxon Valdez ran aground in Prince William Sound, Alaska. That accident caused the hull to rupture, spilling millions of gallons of crude oil into the Sound. It caused an environmental disaster whose effects may never be totally overcome.

In April, 1990, the Megaborg ran aground in the Gulf of Mexico, just off the Texas coast. The ship spilled hundreds of thousands of gallons of oil into the Gulf and caught on fire. Again, such a disaster has caused enormous environmental problems.

In February, 1991, an anchor from the Presidente Rivera punctured an oil pipeline in the Pacific, just off the California coast. That accident again caused hundreds of thousands of gallons of oil to pollute the water and ruin miles of shoreline in southern California.

A large amount of oil is obtained by drilling operations conducted on offshore platforms. Those operations can be very hazardous to the persons working the rig as well as to the environment. For instance, drilling operations by themselves are hazardous because of the flammability of oil and underground pressures encountered when drilling. Such an environment may and has caused explosions and fires.

Another hazard of offshore drilling is caused by the weather. Hurricanes in the Gulf of Mexico and storms in the North Sea create havoc on offshore platforms, putting both workers and the platforms in danger. These hazards have caused numerous deaths, injuries, oil spills and fires throughout the world.

Oil spills and fires have caused enormous environmental problems whose effects can take years if not decades to cure. Presently available means for controlling spills, such as buoys, vacuum ships and fire ships, can be helpful. However, they are limited in ability and if not implemented quickly are greatly inefficient. Also, nothing presently available is capable of totally isolating and containing these disasters. Thus, the need exists to better handle the potential disasters caused by oil exploration, production, and transportation.

Presently there are laws preventing the shipping of certain cargoes in the same vessel. For instance, there are prohibitions against shipping foodstuffs on the same vessel with chemical fertilizers, even though the cargoes are kept in isolated sections of the ship.

These regulations can cause several problems. For example, a ship may have to wait at port to be loaded with only specific types of cargo which can cause costly time delays. However, if it were capable of carrying all sorts of cargo, it is more likely that it would be in and out of port more quickly.

Another problem arises where the ship cannot be fully loaded. For instance, if a ship is capable of handling more cargo than is available at the port, it will have to make at least part of its voyage without being fully loaded. Thus, the need exists to handle oceangoing cargoes more efficiently.

This background section is intended to discuss some of the problems associated with the production handling of oil in oceangoing vessels and pipelines. It is not meant to be exhaustive of those problems but to show that there is a need for improvement.

SUMMARY OF THE INVENTION

This invention provides prevention and cure to some of the problems associated with transporting cargo across water and in offshore drilling operations. The present invention is a cure by reducing the need for underwater pipelines. It prevents and reduces environmental disasters through its capability of containing and isolating tankers, barges, and drilling rigs.

The present invention is directed to a multi-purpose modularly constructed vessel. The vessel includes bow, center and stern sections.

The bow section is disposed in the front of the vessel. The bow section includes means for propelling and navigating the vessel. It also includes a means for controlling all functions of the vessel or port.

The center section is disposed between the bow and stern sections and comprises at least one containment unit and a door unit disposed at each end. Each containment unit includes a means for maneuvering, cooling, controlling fires, controlling buoyancy, and connecting to another containment unit or door unit. Each containment unit may also include a means for handling cargo.

The stern section is disposed at one end of the center section. The stern section is conformed to reduce harmful turbulence. The stern section includes a mean for steering and aligning the invention when underway.

The invention provides advantages in handling and salvaging disabled vessels. The invention is capable of containing and isolating any known vessel because it may be built to accommodate any height and width and its modular construction provides limitless length. The buoyancy control allows the inventive vessel or center section to be sunk to the level of a disabled vessel.

The invention also provides an efficient means of transporting various types of cargo at the same time. The containment section is capable of holding several separate barges or vessels. Each vessel may be used to hold various types of cargo, even cargo that may not be carried by the same vessel.

The present invention provides advantages in navigation. The vessel may be built large enough to be tracked by satellite and to cross oceans without deviation regardless of wave direction, currents and weather conditions.

The present invention provides advantages in adverse weather conditions. The center section is capable of containing and isolating cargo from adverse conditions. The modular construction allows the vessel to bend, placing less stress on the vessel in rough weather. The buoyancy system allows the vessel to submerge to avoid rough weather, while maintaining the cargo and crew in a dry and protected environment.

The features and benefits of the present invention are meant to be illustrative rather than exhaustive. Further benefits and features of the present invention will become apparent while reviewing the Detailed Description of the Preferred Embodiment of the Invention.

BRIEF DESCRIPTION OF THE DRAWINGS

FIG. 3 is a top cross sectional view of the bow section and first two containment sections.

FIG. 4 is a side partially broken away cross sectional view of the bow and first door section.

FIG. 5 is a partial break away side cross sectional view of the bow and first door section.

FIG. 6 is a side cross sectional view of a pump assembly.

FIG. 7 is a partially broken away view of the stern section.

DETAILED DESCRIPTION OF THE PREFERRED EMBODIMENT

Figure 1:
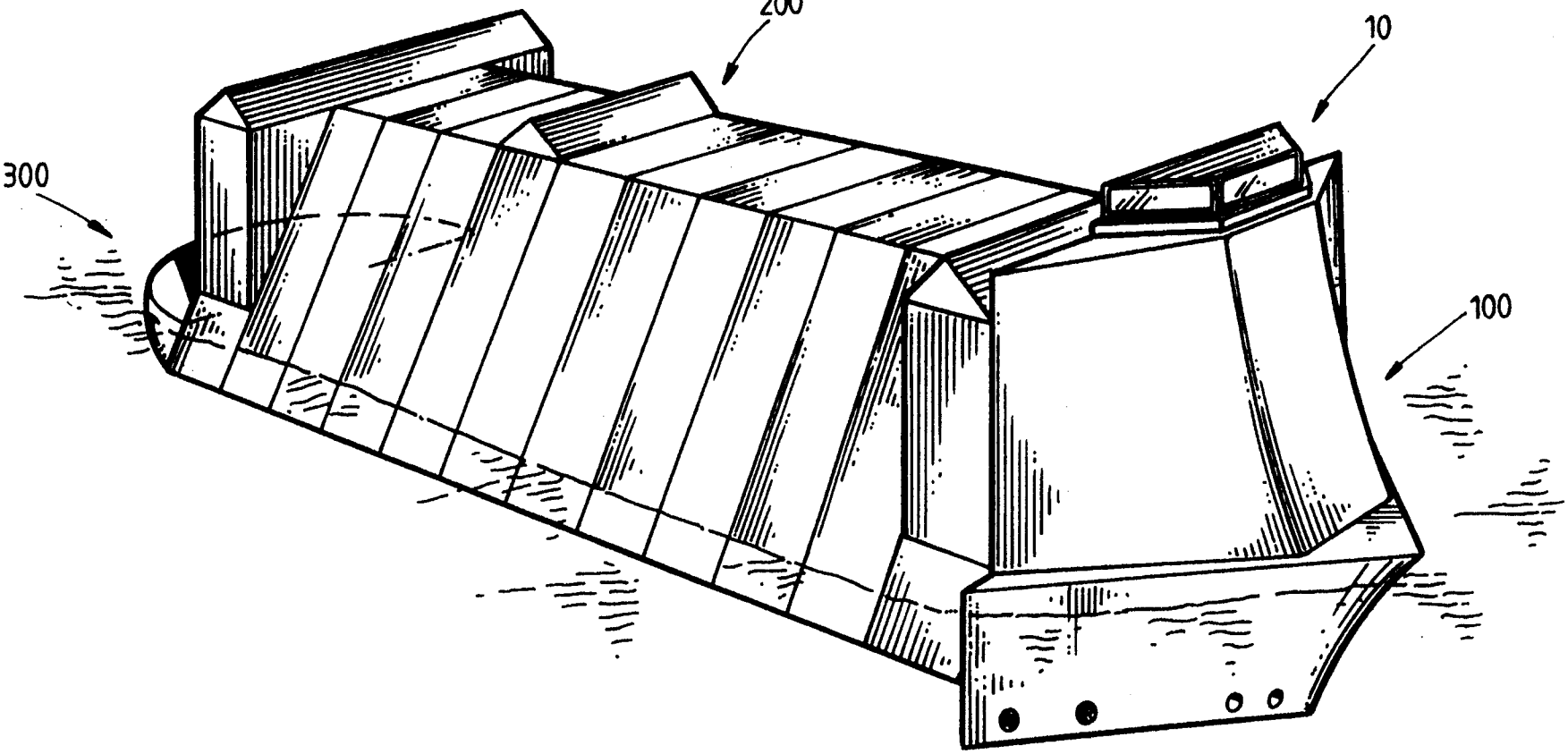
FIG. 1 is an environmental view of Deep-C.
Figure 2:
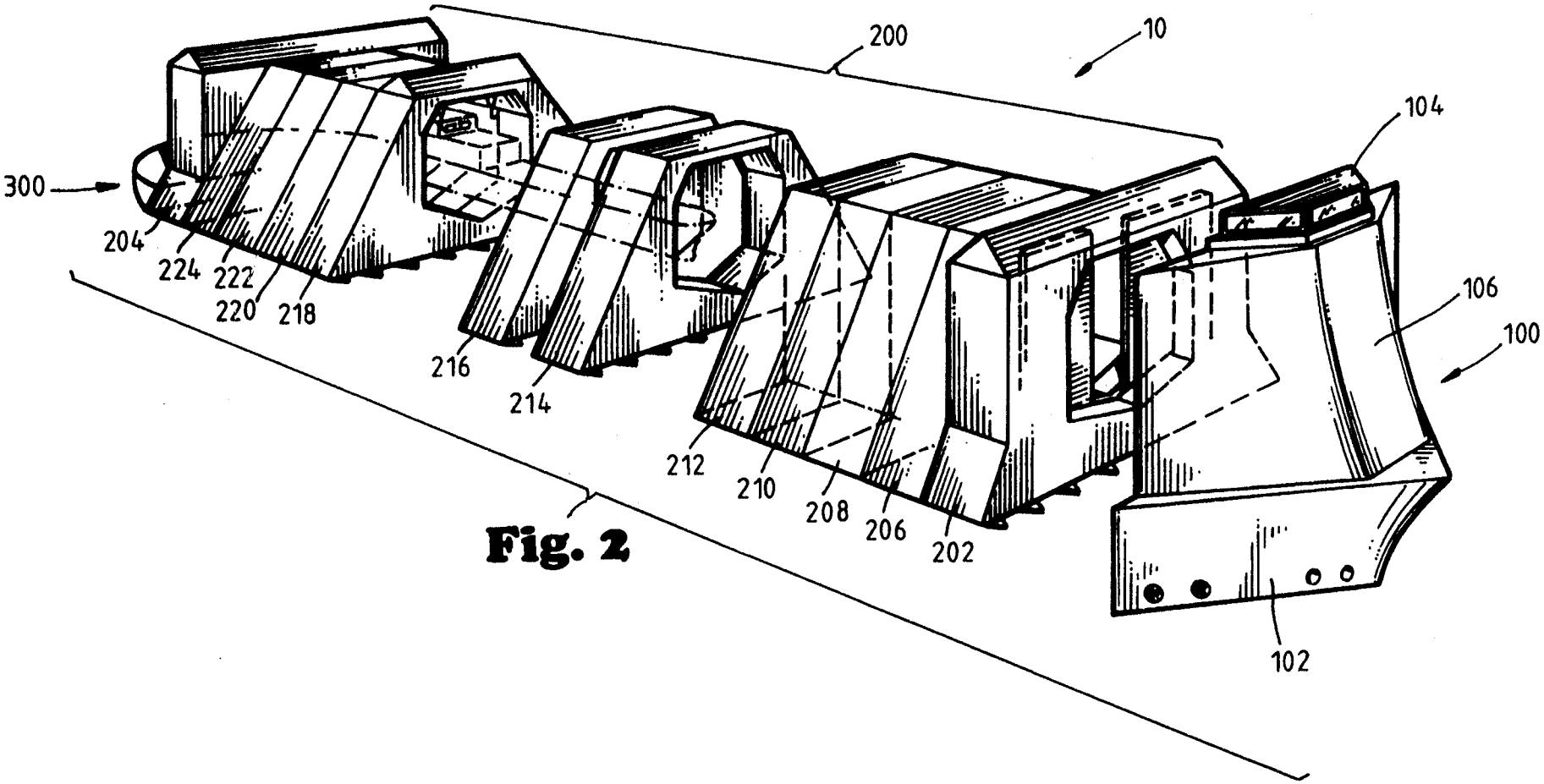
FIG. 2 is an isometric breakaway view of the Deep-C with an oil tanker shown inside.

A preferred vessel 10 is shown in FIGS. 1 and 2. The vessel 10 includes a bow section 100, center section 200, and stern section 300.

Bow Section 300

The bow section 100 is shown in FIGS. 1 and 2. The bow section 100 includes a main propulsion system 102, central control system 104, and crew accommodations 106.

The preferred main propulsion system, 102 is disposed in the lower position of the bow section 100 and is best shown in FIGS. 3, 4 and 5. The main propulsion system 102 includes intake ducts 110–116, drive means 118–124, and propulsion tubes 128–142.

The drive means 118–124 preferably include steam turbines 144 that drive water turbines 146. Other power sources and propulsion means may be used. Also, the orientation of the drive may be altered. FIG. 4 shows a system with a right angle orientation while FIG. 5 shows an inline orientation.

The central control system 104 is disposed in the top of the bow section 100. The central control system 104 provides remote control for the entire vessel including all functions of the center and stern sections.

Crew accommodations 106 are disposed in the second level of the bow section 100. Crew accommodations can be made to accommodate the needs of virtually any number of crew members for any length of voyage.

Center Section 200

The center section 200 is shown in FIGS. 1 and 2. The center section 200 includes at least two door units 202 and 204 disposed on each side of and at least one containment unit 206–224. A preferred center section may include nine containment units 206–224 with door unit 202 and 204 disposed on each end. It is also preferable to include at least one crane equipped containment unit such as 218.

Any combination of door units and containment; units may be used. Also, the center section may be used without bow or stern sections in certain applications.

Figure 8:
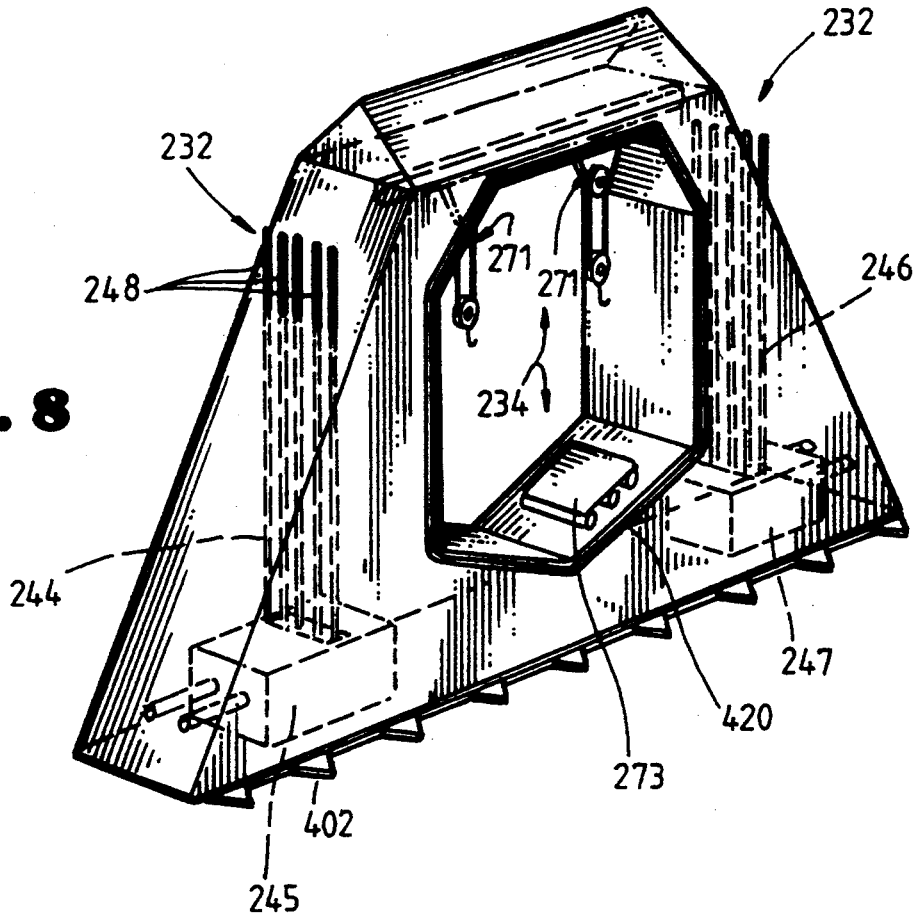
FIG. 8 is an isometric view of a containment section including a crane.
Figure 9:
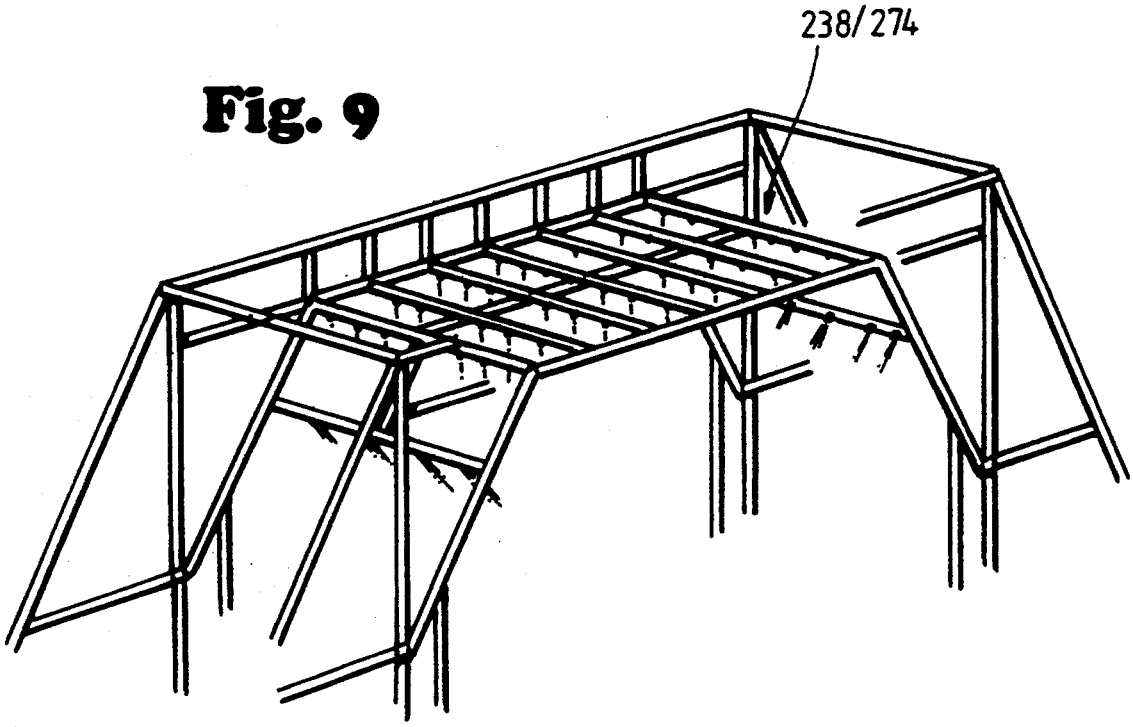
FIG. 9 is a partial isometric view of the infra structure of a containment section.
Figure 11:
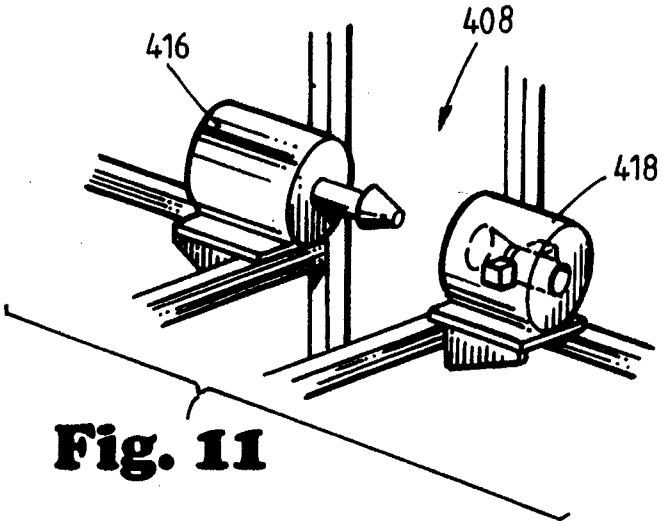
FIG. 11 is a isometric view of one connecting pin assembly.
Figure 10:
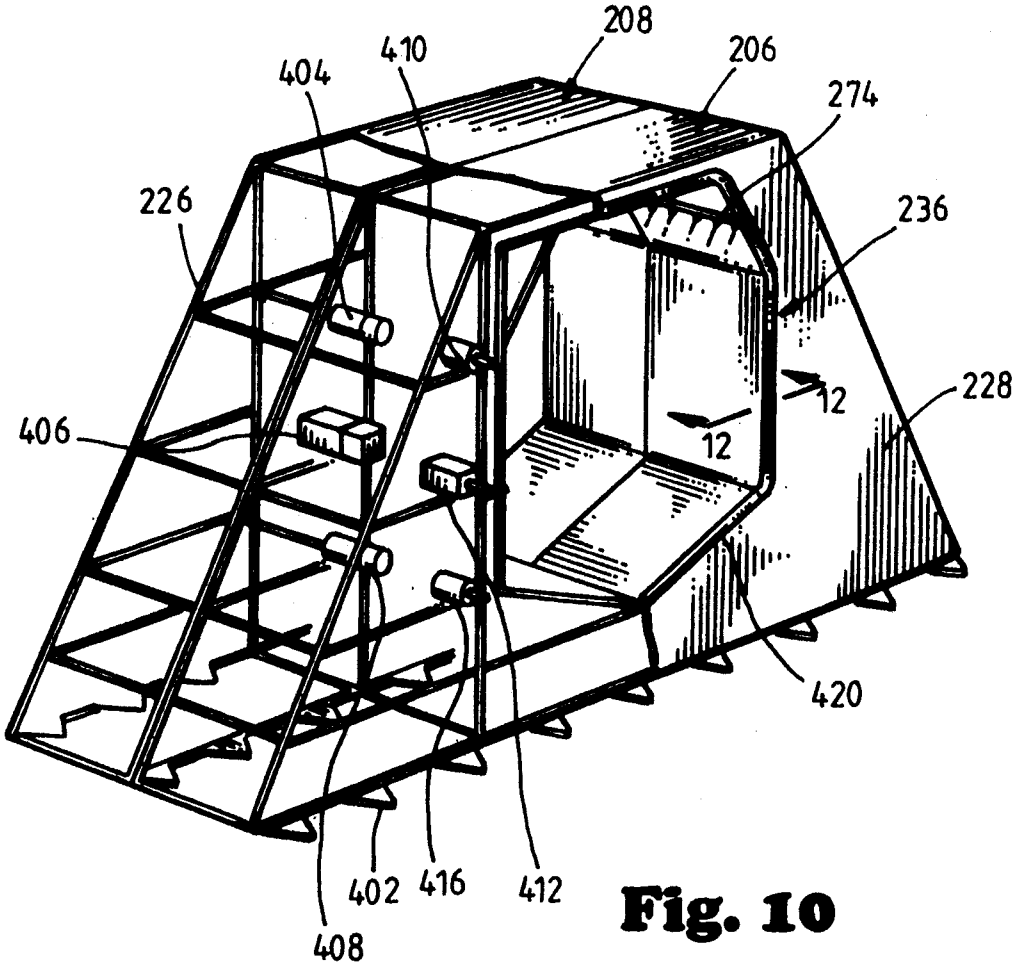
FIG. 10 is an isometric partially broken away view of the first two containment sections.
Figure 13:
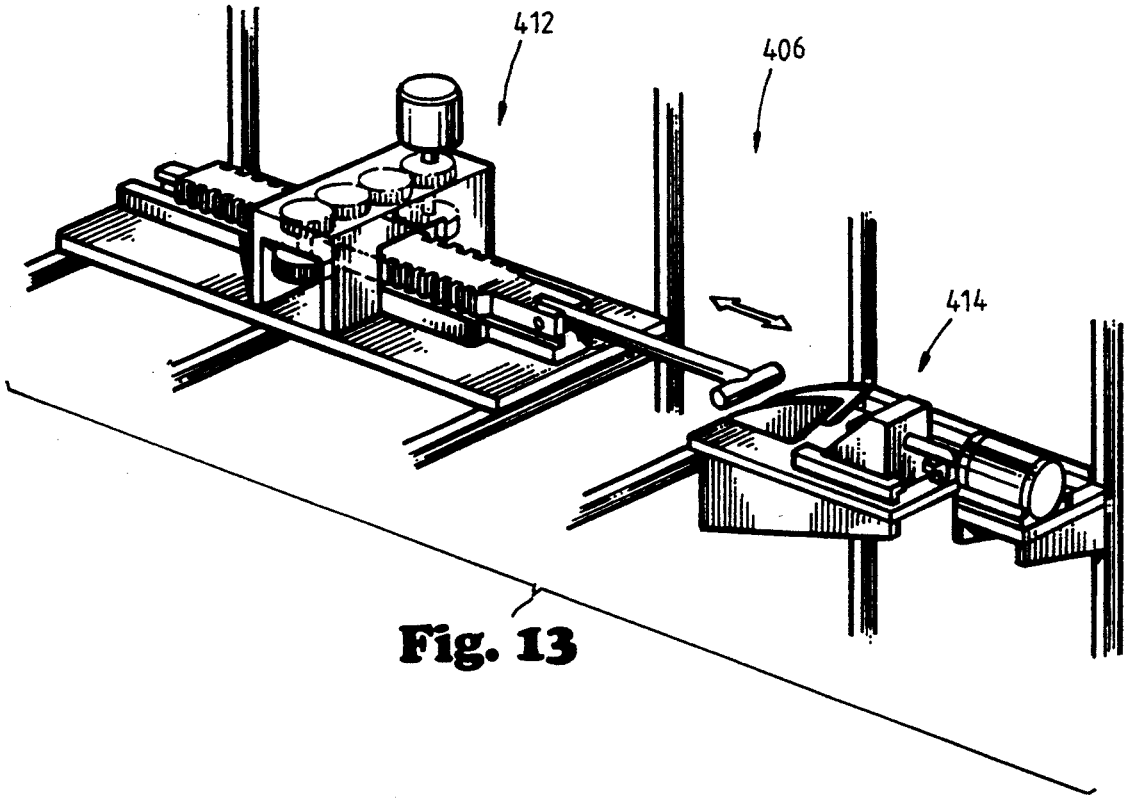
FIG. 13 is an isometric view of a tractor pull assembly.

Containment units are shown in FIGS. 8, 9 and 10. Preferably the containment units are constructed of a pipe frame 226 that is covered with plated steel 228.

The preferred containment unit frame has a trapezoidal cross-sectional shape with a 725 foot base, 375 foot height and a 100 foot length. An interior opening having a hexagon cross-sectional shape defines the interior cavity of the system. Preferably the dimensions of the interior include a 275 foot height and a 270 foot width.

The containment units 206 and 208 include a maneuvering system 230, buoyancy system 232, a cargo handling system 234, a cooling system 236, and a fire control system 238.

The maneuvering system 230 is shown in FIGS. 4 and 5. The system 230 is retractably disposed on the bottom of each containment unit. The system includes a rotatable thruster 240 that is preferably a water turbine mounted on a turntable.

The buoyancy system 232 is shown best in FIG. 8 and is disposed in the bottom of each containment unit. The buoyancy control system 232 includes two flooding units 244 and 246. Each flooding unit includes flood compartment 245 and 247 and at least one flooding assembly 248.

A partial view of flooding assembly 248 is shown in FIG. 6. Each flood assembly 248 includes a flood tube 250, discharge tube 252, pump assembly 254 and valve 256.

The pump assembly 254 includes a screen 258, motor 260, pump stages 262–268 and an expandable bladder 270 disposed around pump stage 268. The bladder isolates discharging sea water from incoming sea water. A cable 272 is mounted to the bladder 270 for inflation and deflation and to pull the pump assembly 254 for service and repair.

The buoyancy control system 232 allows the vessel 10 to be sunk to various depths. It also assists in steering and braking the vessel by selectively flooding the flood compartments of various containment and door units.

The cargo handling system 234 is disposed in the interior cavity of each containment unit. The cargo handling system 234 may include partial flooding of the interior, overhead crane 271 (see FIG. 8) and interior pontoons 273 to assist in handling and maneuvering vessels.

The cooling system 236 (see FIG. 10) is disposed in the interior walls of the containment unit 206. Preferably, it includes a means for providing water to fill water jackets not shown disposed between the plating 228 and the pipe frame 226.

The fire control system 238 is best shown in FIG. 9. The fire control system 238 is disposed inside the interior pipe structure 228 and includes a plurality of nozzles 274. The nozzles 274 are used to spray the interior cavity of the containment unit with fire inhibiting liquids and chemicals. Preferably use of liquid carbon dioxide and water would be used in the fire control system.

Figure 14:
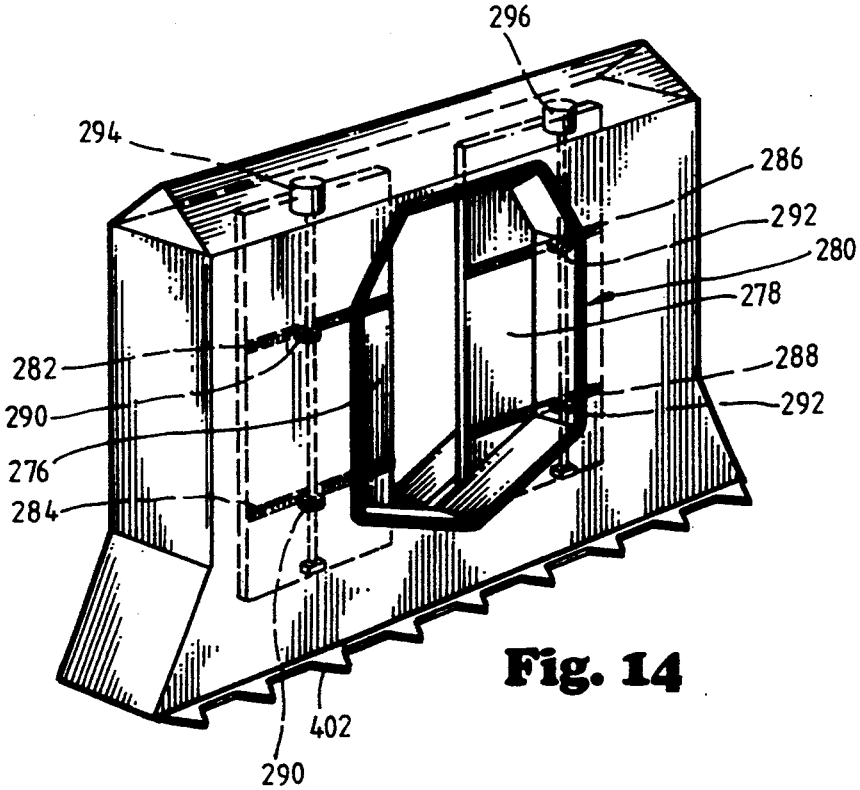
FIG. 14 is an isometric view of a door unit.

The door unit 202 is shown in FIG. 14. The door unit 202 includes doors 276 and 278, and actuating system 280. The door 202 unit includes a cooling system, maneuvering system and fire control system (not shown) similar to the containment section systems.

The preferred door unit frame has a trapezoidal cross-sectional shape with a 725 foot base, 375 feet in height and 100 feet in length. The frame is constructed of a pipe frame that is covered with plated steel.

The means for actuating 280 the doors 276 and 278 include a series of racks 282–288 and pinions 290 and 292 driven by motors 294 and 296.

Stern Section 300

The stern section 300 is shown in FIGS. 1, 2 and 7. The preferred stern section 300 includes a steering and alignment system 302 and is conformed to reduce harmful turbulence.

The preferred steering and alignment system 302 includes retractable rudders 304 and 306. The rudders 304 and 306 may be oriented by the central control system 104 to steer the vessel and/or may be oriented to cause drag to keep the vessel oriented in a straight line.

Connecting System 400

The vessel 10 is constructed in units and sections. As previously described the vessel 10 may take on various forms depending on its intended use. Each section or unit includes a self-contained connecting system 400.

The connecting system 400 is shown in FIGS. 10, 11, 12 and 13. The system 400 includes intermeshing teeth 402, conical flexure assemblies 404, tractor pull assemblies 406 and pin assemblies 408.

The intermeshing teeth 402 are disposed on the bottoms of each unit or section. Each containment or door unit also includes a plate that engages the meshing teeth. The teeth 402 provide the initial means of alignment and engagement between two sections being connected.

The conical flexure assemblies 406 include a cone 410 and receiver. This assembly 406 provides a second means of alignment.

The tractor pull assemblies 406 include a rack and pinion draw assembly 412 and slot assembly 414. The tractor pull assembly 406 draws the section or units being connected together. Any number of tractor pull assemblies may be used.

The pin assemblies 408 include a pin 416 that is locked into a flexible receiver 418. The pin assembly 408 allows for movement between connected units or sections and provides a structured means of holding the modular sections of the vessel 10 together.

Figure 12:
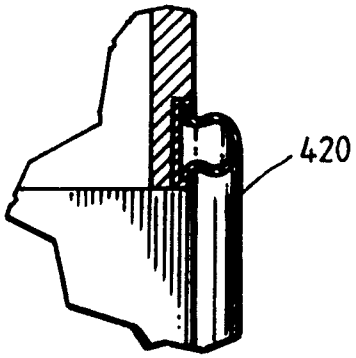
FIG. 12 is a partially broken away and partially cross sectional view of the sealing flange.

The connecting system also includes a means for sealing 420 between units or sections. Preferably the sealing means 420 is a seal preferably a UHMW polyurethene bladder disposed around the perimeter of the interior cavity as shown in FIG. 12.

The connecting system allows the vessel to be assembled and disassembled nearly anywhere. It also provides a means for replacing disabled sections or units.

What is claimed is:

1. A multi-purpose modularly constructed vessel comprising:

(A) a center section comprising:
  (1) at least one containment unit where each comprises:
    (a) a means for maneuvering disposed inside the containment unit;
    (b) a means for controlling buoyancy disposed inside the containment unit;
    (c) a means for handling cargo disposed inside the containment unit;
    (d) a means for connecting the containment unit with another containment unit disposed in the sides of the containment unit;
    (e) a means for cooling disposed inside the containment unit; and
    (f) a means for controlling fires disposed inside the containment unit;
  (2) at least one door section disposed at at least one end of the center section comprising:
    (a) a means for maneuvering disposed inside the door section;
    (b) a means for controlling buoyancy disposed inside the door section;
    (c) a means for connecting a containment unit disposed on each side of the door section; and
    (d) a means for cooling disposed inside the door section;

(B) a stern section disposed at one end of the center section comprising a means for steering and aligning; and (C) a bow section disposed at the end of the center section opposite the stern section comprising:
  (1) means for propelling the vessel disposed inside the bow section;
  (2) means for navigating the vessel disposed inside the bow section;
  (3) means for controlling the containment units disposed inside the bow section;
  (4) means for controlling each door section disposed inside the bow section; and
  (5) means for accommodating the needs of a crew disposed inside the bow section.

2. A vessel according to claim 1 further including a means for assembling the vessel comprising:

(A) at least one detachable propulsion barge and (B) a bow section connecting means.

3. A buoyant modularly constructed port comprising:

(A) at least one containment unit;

(B) at least two door units where one is disposed at each end of the port;

(C) a means for cooling the interior of the port disposed inside at least one containment unit;

(D) means for handling cargo disposed inside the port;

(E) means for handling ships and vessels disposed inside the port;

(F) means for accommodating offshore drilling operations disposed inside the pork;

(G) means for accommodating use of aircraft disposed on top of the port;

(H) means for accommodating the needs of a crew disposed inside the port; and (I) means for controlling the functions of the port disposed inside the port.

* * * * *

UNITED STATES PATENT AND TRADEMARK OFFICE

CERTIFICATE OF CORRECTION

PATENT NO. : 5,347,944

DATED : September 20, 1994

INVENTOR(S) : William Lamb, et. al.

It is certified that error appears in the above-indentified patent and that said Letters Patent is hereby corrected as shown below:

Column 6, line 59, "pork" should be -- port --.

Signed and Sealed this

Thirteenth Day of December, 1994

*Attest:*

*Attesting Officer*

BRUCE LEHMAN

*Commissioner of Patents and Trademarks*